United States Patent [19]

Kalkaslief

[11] 4,198,791

[45] Apr. 22, 1980

[54] STANDARD MODULES FOR ARCHITECTONIC COMPOSITIONS

[76] Inventor: Methodios Kalkaslief, Rua Berlioz, 474, Sao Paulo, SP, Brazil

[21] Appl. No.: 903,474

[22] Filed: May 8, 1978

Related U.S. Application Data

[63] Continuation of Ser. No. 768,836, Feb. 15, 1977, abandoned.

[30] Foreign Application Priority Data

Apr. 28, 1976 [BR] Brazil ..... 7602636

[51] Int. Cl.[2] ..... A47K 3/16

[52] U.S. Cl. ..... 52/35; 52/79.1

[58] Field of Search ..... 52/34, 35, 79.1, 79.4, 52/234

[56] References Cited

U.S. PATENT DOCUMENTS 2,665,454 1/1954 Krenov ..... 52/34 X 3,162,863 12/1964 Wokas ..... 52/79.1 X

FOREIGN PATENT DOCUMENTS 302351 7/1968 Sweden ..... 52/79.1

OTHER PUBLICATIONS

"All Metal, Compact One-Wall Unit Kitchen," *American Builder,* 9-1946, p. 102.

*Primary Examiner*—Carl D. Friedman

*Attorney, Agent, or Firm*—Robert E. Burns; Emmanuel J. Lobato; Bruce L. Adams

[57] ABSTRACT

An angular construction module made of two separate bedrooms alongside a double bathroom unit. The bathroom unit has a dividing wall dividing it into two equal symmetrical bathroom spaces. The dividing wall has a diagonal wall portion on which lavatories are disposed back-to-back. Each bedroom has a wall in common with the bathroom unit. A door access is provided in each common wall for entry from each respective bedroom to a corresponding one only of the bathroom spaces.

1 Claim, 1 Drawing Figure

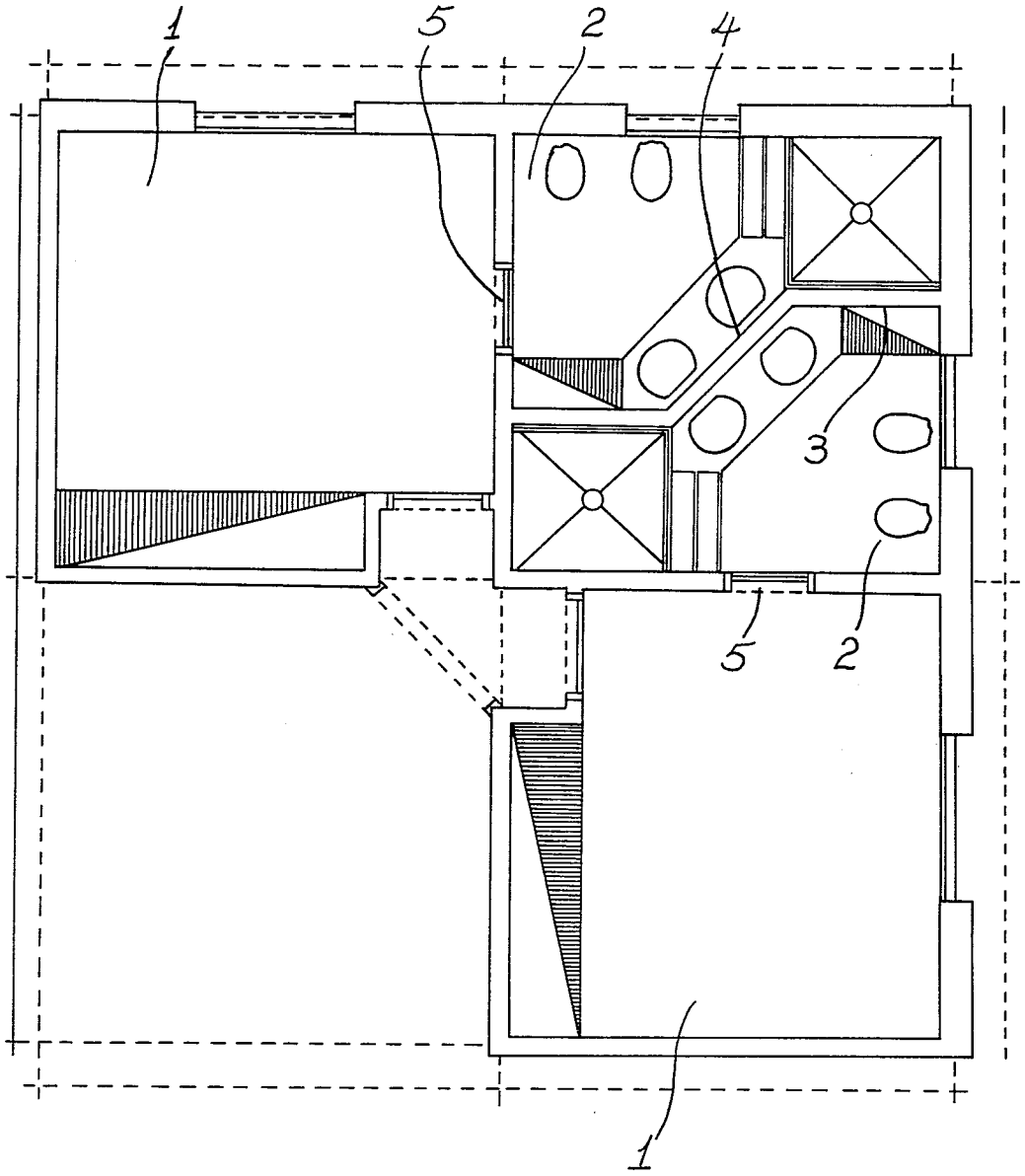
1
5
2
4
3
5
2
1

STANDARD MODULES FOR ARCHITECTONIC COMPOSITIONS

This is a continuation of application Ser. No. 768,836, filed Feb. 15, 1977, now abandoned.

BACKGROUND OF THE INVENTION

As it is well known to those skilled in the art of home building, modern constructions, e.g. apartment buildings or hotels, lack a standard construction module which could provide for a maximum utilization of the space available for each construction unit.

More specifically, it has been observed that in the above mentioned buildings the space available for each construction unit, e.g. apartment or hotel room or suite, is subdivided in a rather arbitrary way through a mere lateral juxtaposition or grouping of rooms of a similar, related or even diverse nature, hence the need for halls, corridors, antechambers or the like to interconnect the rooms involved, the addition of which resulting in a significant waste of space, as well as greater expenses in respect to labor and material.

Besides, one has to consider that such arbitrary division of space also brings about a plurality of problems concerning water, power and security installations and others, as well as the characteristics of the building facade itself.

SUMMARY OF THE INVENTION

In order to overcome the disadvantages and limitations of the current partitioning of space in construction units, the module of the present invention has been devised. It can be applied to the construction of apartment buildings and hotels, and also to many other types of dwellings, regardless their dimension or geometrical shape.

The module of the present invention comprises essentially two independent bedrooms, with two bathrooms coupled thereto, the four rooms forming an assembly consisting of two suites disposed in angles, this disposition characterizing the novelty of the present invention.

The modular disposition comprising the module of the present invention affords a considerable reduction in the internal circulation area of the unit, through the suppression of halls or similar circulation or entrance means, whereby the space once used in such areas can be added to other sections in the dwelling, such as the living-room, dining room etc., or can be deducted from the total area of each unit. In addition, such standardization completely eliminates the spacial inflation of arbitrary areas and creates a new division in space, in the sense of a "compact centripetal architecture", in place of a "lineal centrifugal architecture" which is currently in use.

One of the advantages of the application of the standard module of the present invention is that it allows the possibility of reduction or proportional enlargement of the projected area without causing any alteration to the architectonic or structural composition of the building involved, thus enabling a standardization of bedrooms and bathrooms and forming a flexible basis for architectonic compositions to be applied to dwelling constructions of any sort, the standard module being a virtual constant, and so giving rise to a new principle in spacial planning.

Moreover, the standard module of the present invention simplifies and rationalizes the building structure, as well as the installation of hidraulic and electrical equipment, sound and air conditioning systems, which will result in an economy in the order of 30 to 50% of equipment built in the walls. An optimum balance to the structure is also thereby maintained and its costs can be reduced in about 20%.

Furthermore, the standard module provides for external plastic versatility of projected bulks or volumes in continual or alternate order, both in the horizontal and in the vertical plane, without any substantial alteration in the structure or the architectonic composition, the central core of the building being maintained constant.

BRIEF DESCRIPTION OF THE DRAWINGS

The present invention can be better understood in reference to the accompanying drawing, in which the sole FIGURE is a plan view of the standard module of the present invention as forming a basis for the project of a floor of an apartment building, hotel or the like, said module being illustrated only as an example so far as its geometrical shape and dimensions are concerned, and being not limited thereby since other embodiments thereof can be effected including other geometrical shapes and other dimensions.

DESCRIPTION OF THE PREFERRED EMBODIMENTS

According to the sole FIGURE in the drawing, the standard module of the present invention is comprised essentially of two independent bedrooms 1, with two independent bathrooms 2 symetrically disposed and separated by a common wall 3 having its middle section 4 aligned diagonally in respect to the end sections thereof, each of said bathrooms 2 being connected to each of said bedrooms 1 by means of doors 5, thus forming an assembly of double suites in angles or corners. The two independent bathrooms 2 are provided with symmetrically disposed lavatories 10 disposed in a back-to-back relationship.

Of course the number of standard modules to be used in a building will depend on the specific design for each floor and the number of apartments or hotel rooms or suites desired, each module being always positioned in a corner, advantage being taken, whenever possible of the external and internal corners extant on each floor.

It should be pointed out that, besides the possibility of eliminating halls or similar entrance or circulation means, the assembly of suites in angles, with the bathrooms disposed in the corners thereof, enables the symetrical positioning of corresponding sanitary fittings, the sole division wall between each of the bathrooms being used for most of the installation of pipes for the feeding and drainage of water, this representing a significant economy as compared with conventional construction systems.

Moreover, the standardization of the suite assemblies favors to a great extent the facades of the buildings involved, once the conventional projections or unlevelled sections which so much harm the aesthetic harmony of the building can be eliminated.

What is claimed is:

1. An angular construction module comprising; a double bathroom unit for use as a corner of a building and having four sidewalls enclosing the bathroom unit, a dividing wall dividing the unit into two equal and symmetrical bathroom spaces, said dividing wall having a diagonal wall portion diagonally dividing the unit, said bathroom spaces having lavatories back-to-back along said diagonal wall portion; a first bedroom constructed with one sidewall thereof in common with an inner sidewall of said bathroom unit and a door access in the common sidewall for entry into one of the bathroom spaces; a second bedroom constructed with one sidewall thereon in common with another inner sidewall of said bathroom unit and a door access in the common sidewall for entry into the other bathroom space, the other sidewalls of the double bathroom unit meeting at 90° being free of doors and defining outermost corner walls of a building, and each bedroom having an outer wall contiguous with a corresponding outer wall of said bathroom unit whereby the module defines an external corner of a building.

* * * * *